US005341616A

United States Patent [19]

Penzkofer

[11] Patent Number: 5,341,616

[45] Date of Patent: Aug. 30, 1994

[54] CONCRETE INSERT ELEMENT AND CONCRETE STRUCTURE HAVING AT LEAST ONE CONCRETE INSERT ELEMENT

[75] Inventor: Ludwig Penzkofer, Leiblfing, Fed. Rep. of Germany

[73] Assignee: Max Frank GmbH & Co KG, Fed. Rep. of Germany

[21] Appl. No.: 702,264

[22] Filed: May 17, 1991

[30] Foreign Application Priority Data

| | | | |
|---|---|---|---|
| Feb. 2, 1991 | [DE] | Fed. Rep. of Germany | 9101219 |
| Mar. 23, 1991 | [DE] | Fed. Rep. of Germany | 4109706 |
| May 17, 1991 | [DE] | Fed. Rep. of Germany | 3015886 |

[51] Int. Cl.[5] ..... E04B 1/16

[52] U.S. Cl. ..... 52/340; 52/659; 428/653

[58] Field of Search ..... 52/334, 340, 659; 428/653

[56] References Cited

U.S. PATENT DOCUMENTS

| | | | |
|---|---|---|---|
| 3,682,718 | 8/1972 | Palm et al. . | |
| 3,957,608 | 5/1976 | Streel | 428/653 |
| 4,150,179 | 4/1979 | Jones | 428/653 |
| 4,401,727 | 8/1983 | Berke et al. | 428/653 |
| 4,517,229 | 5/1985 | Nickola et al. | 428/653 |
| 4,722,871 | 2/1988 | Radtke | 428/653 |
| 4,978,588 | 12/1990 | Adaniya et al. | 428/653 |
| 5,049,202 | 9/1991 | Willis et al. | 428/653 |
| 5,100,738 | 3/1992 | Graf | 428/653 |

FOREIGN PATENT DOCUMENTS

| | | | |
|---|---|---|---|
| 152015 | 8/1985 | European Pat. Off. . | |
| 457315 | 11/1991 | European Pat. Off. . | |
| 2150321 | 4/1973 | Fed. Rep. of Germany . | |
| 2908575 | 9/1980 | Fed. Rep. of Germany . | |
| 8717227 | 11/1988 | Fed. Rep. of Germany . | |
| 8810306 | 2/1989 | Fed. Rep. of Germany . | |
| 2450921 | 10/1980 | France . | |
| 35261 | 4/1977 | Japan | 428/653 |

*Primary Examiner*—Carl D. Friedman
*Assistant Examiner*—Lan C. Mai
*Attorney, Agent, or Firm*—Lucas & Just

[57] ABSTRACT

A concrete structure having at least one concrete insert element is disclosed. The insert element has a surface with a layer of aluminum or aluminum alloy and, upon setting of the concrete, the layer of aluminum or aluminum alloy reacts at least partially with the free lime and oxygen in the concrete to form calcium aluminate, thus providing a particularly intimate and firm bond between the insert element and the concrete.

10 Claims, 3 Drawing Sheets

Figure 1:
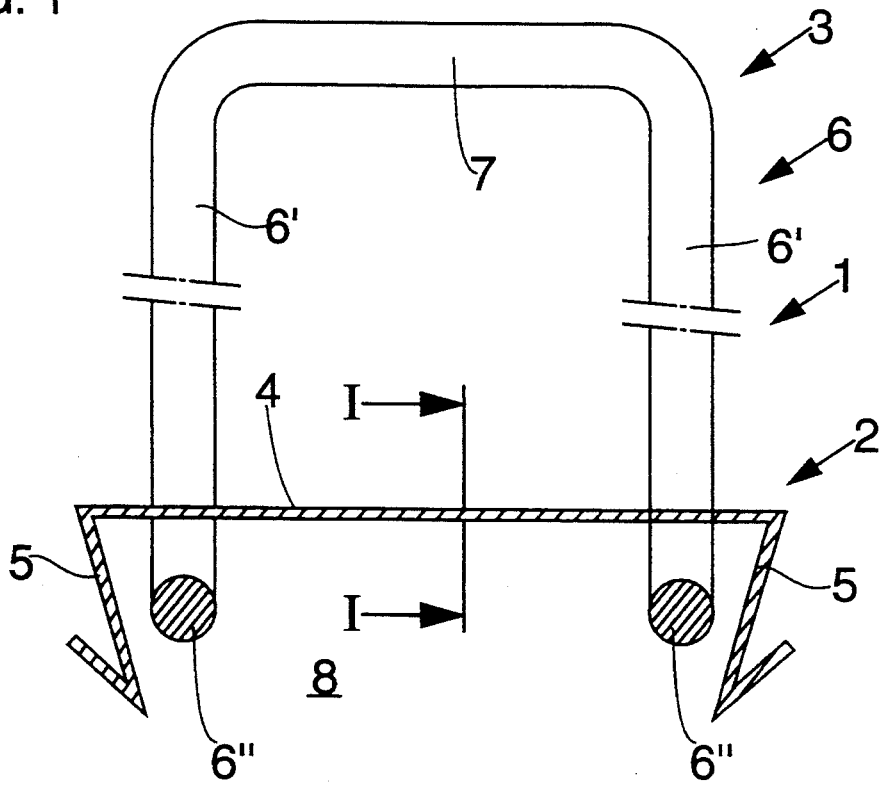

CONCRETE INSERT ELEMENT AND CONCRETE STRUCTURE HAVING AT LEAST ONE CONCRETE INSERT ELEMENT

In the sense of the invention, "concrete insert element" means, very generally, a structural member for concrete construction which, in at least a partial region, is made of steel and in this partial region has at least one surface by which the concrete insert element, upon its use, is embedded or anchored in concrete or cement of a structure. Such concrete insert elements may have a wide variety of functions and hence a wide variety of constructions as well. Thus, such insert elements are, for example, forms in the form of lost form elements, such as elements of curing forms, expanded metal with ribs, securing elements of so-called reinforcing connections, etc. In addition, concrete insert elements are, for example, rods for wall thickness or form anchors, i.e., for example, rod-like elements which are used to hold two facing form walls of a concrete form at a given distance apart, etc.

A problem with concrete insert parts or elements consists basically in that often at the transition between the concrete insert element and the adjacent concrete or cement a tight seal and especially a moisture-tight seal cannot be secured or else can be secured only by special measures.

In the simplest case, a "concrete structure" in the sense of the invention is a concrete wall or some other concrete structural member. However, two concrete structural members adjoining one another or the transition or connecting region of such structural members are alternatively a concrete structure in the sense of the invention. The abovementioned disadvantages of course likewise apply in the case of concrete structures which have such concrete insert elements.

The object of the invention is to provide a concrete insert element or a concrete structure which avoids the abovementioned disadvantages and secures a particularly tight seal even at the transition to the concrete or cement.

In this connection, the invention is based on the knowledge that problems with respect to tightness can be avoided by a particularly intimate and firm embedding of the concrete insert element in the concrete or in the cement. This particularly intimate and firm binding is obtained in that the layer of aluminum or of the aluminum alloy reacts with the free lime of the cement with cooperation of oxygen to form a calcium aluminate, which ensures firm and tight binding of the concrete insert element, so that no cracks, etc. are produced at the transition from the concrete to the insert element, especially and even in case of static or dynamic loads.

In the invention the thickness of the aluminum layer or the layer of the aluminum alloy is selected so that when the concrete sets adequate formation of calcium aluminate takes place and upon completion of this reaction at most only a residual layer of aluminum or of aluminum alloy remains, with very little thickness.

The concrete structural member according to the invention is, for example, a forming device or part of a forming device for use in the concrete structure in the production of a first concrete structural member, for example, a concrete wall, and a second adjoining concrete structural member, for example a concrete wall, with a device serving for insert in a form for the first concrete structural member for securing reinforcing rods to be anchored in this concrete structural member, with a profile-shaped securing element forming this device, which element has two legs and a base through which the reinforcing rods are passed in such fashion that their anchoring regions are arranged on one side of the base and their connecting parts, to be bent out for connection to the second concrete structural member to be connected, are arranged on the other side of the base in an interior space of the securing element delimited by the base and the legs, which element, by a side of the inner surface of a form wall facing the base, lying adjacent, is capable of attachment to this form wall.

The securing element and/or the reinforcing rods have the layer of aluminum or of the aluminum alloy. The device in addition possesses a material which projects beyond at least one longitudinal and/or transverse side of the securing element and has a roughened surface or projections and/or is provided with a concrete retarder. This material is, for example, a wood material (e.g., wood slat or wood strip) with a roughened surface (with a saw-rough surface, i.e., one not sanded after sawing). However, the material is preferably at least one blank of a flat material having projections and/or provided with a concrete retarder, which material, at the inner surface of the form wall, may be provided with a section projecting beyond at least one longitudinal and/or transverse side of the securing element.

The at least one blank of the flat material provided with projections and/or with a concrete retarder produces, laterally from the securing element, i.e., where the covering of concrete is necessary, a roughening or profiling of the age-hardened concrete of the concrete structural member made available first, so that after completion of the two concrete structural members the connecting concrete structural member is likewise "toothed" in the region necessary for the concrete covering by the concrete structural member made available first or its concrete. With optimal concrete covering a substantial improvement in the transfer of shearing force is thus obtained, since the region necessary for the concrete covering likewise contributes to this transfer of shearing force.

Figure 2:
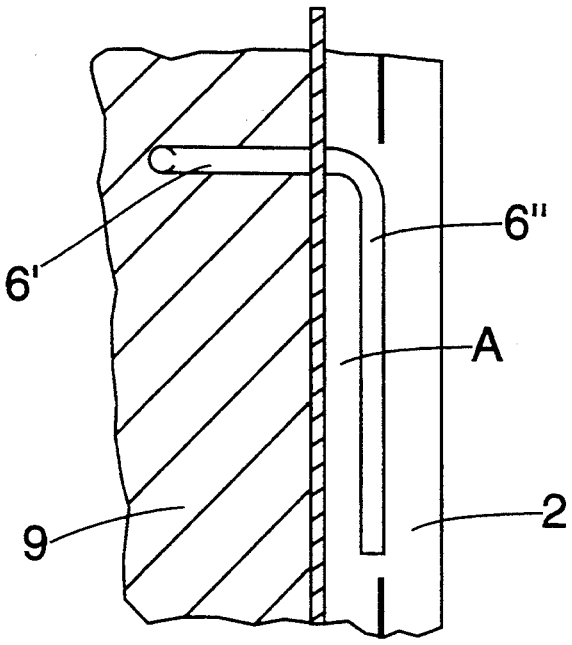
Figure 3:
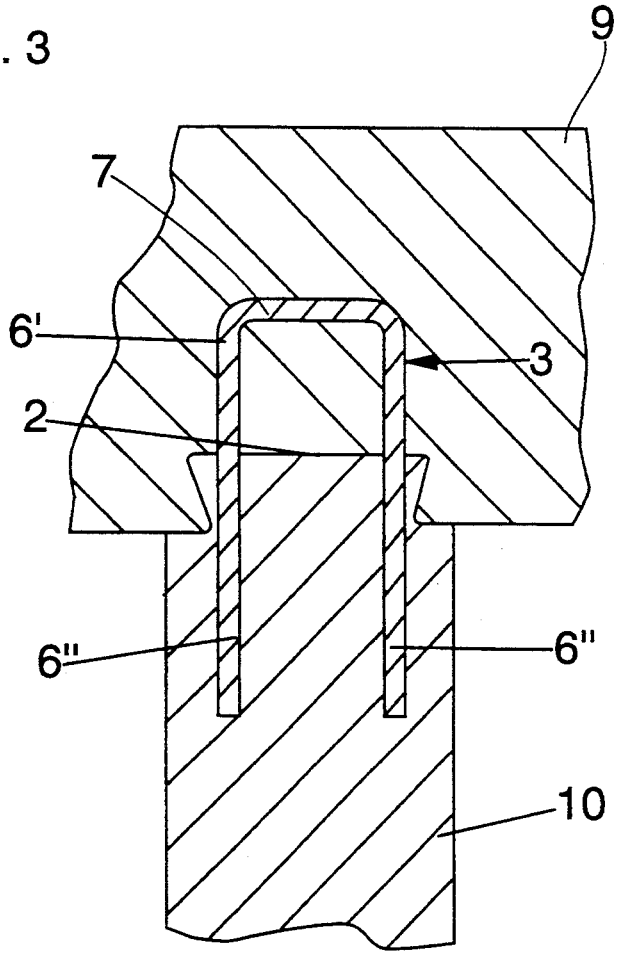
Figure 4:
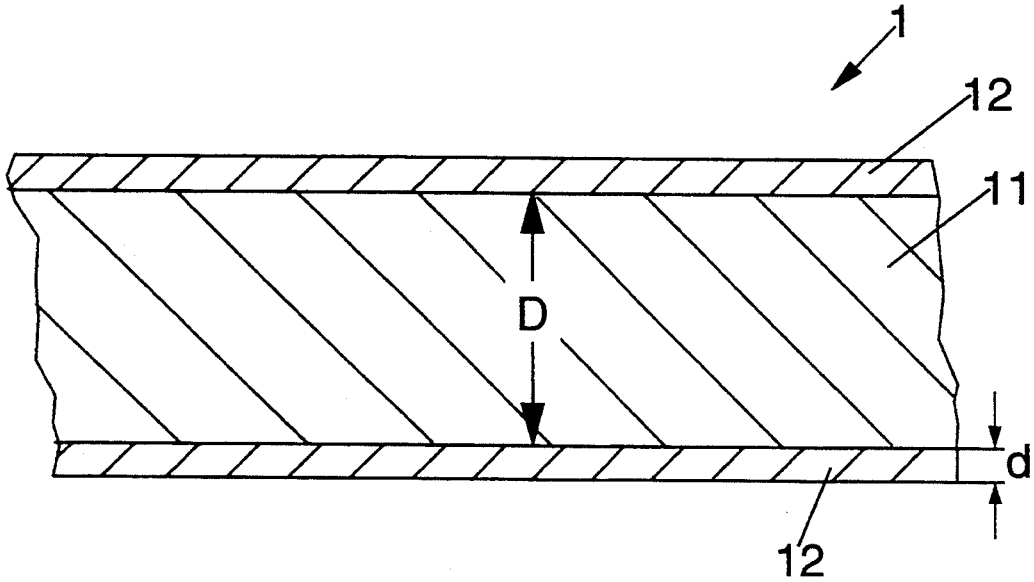
Figure 5:
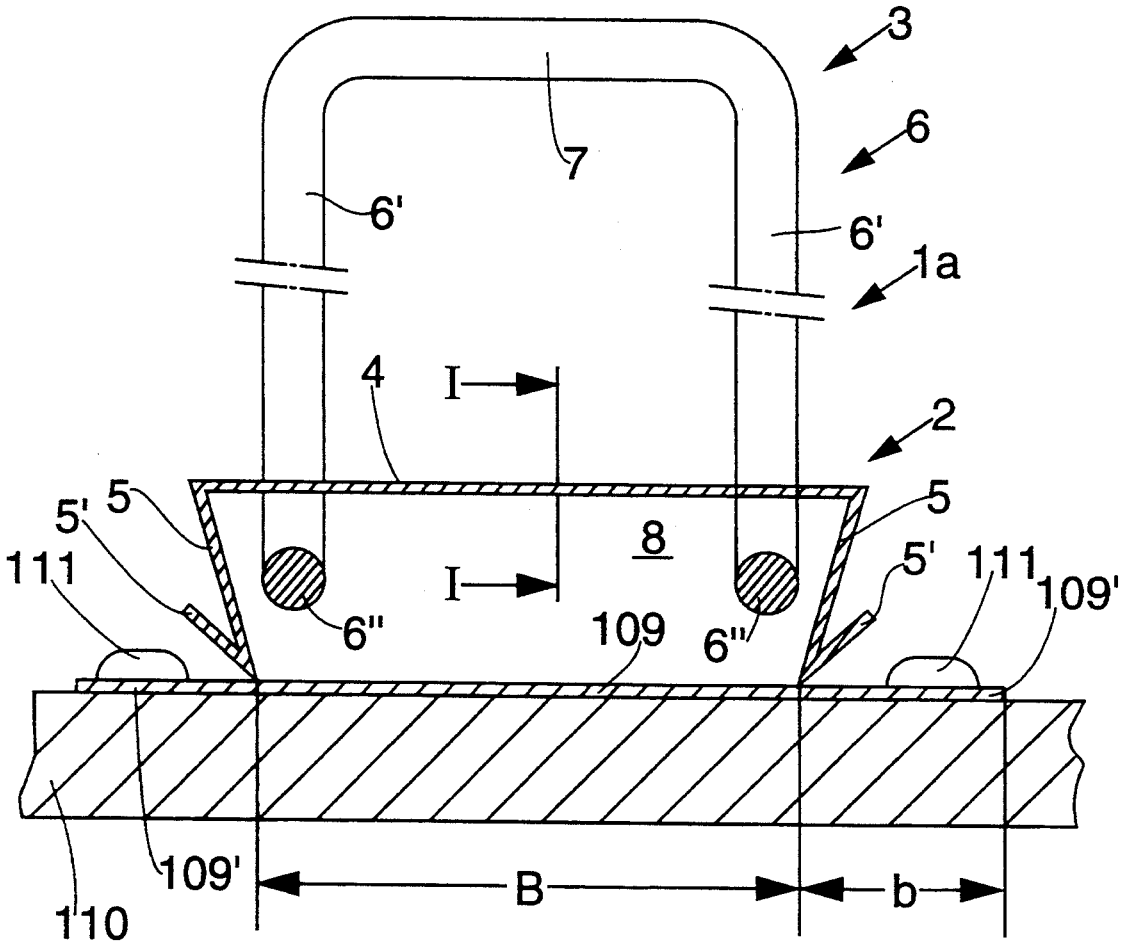

By way of an example in the form of a reinforcing connection, the invention is explained in detail below by means of the figures, wherein:

FIG. 1 shows, in cross section, a reinforcing connection or device serving for insert in a form for a concrete structural member;

FIGS. 2 and 3, a partial length of the device in longitudinal section embedded in a concrete structural member made available first, in longitudinal section or in cross section similar to FIG. 1, but together with two adjoining concrete structural members;

FIG. 4, a section along line I—I of FIG. 1;

FIG. 5, in a representation similar to FIG. 1, another embodiment of the invention.

In the figures, element 1 is a reinforcing connection, i.e., a device serving for insert in a form for a concrete structural part, which consists essentially of a box-shaped or profile-shaped securing element 2 and of a plurality of U-shaped bars or reinforcing rods 3, in each instance made of lengths of concrete steel, by bending.

The securing element has essentially a base 4 and two legs 5, made in one piece with this base by being bent at an angle, which extend away over a common side of the base 4 and enclose a sharp angle with the latter in such fashion that a dovetailed profile is produced for the securing element 2. Each reinforcing rod 3 has two arms 6, which are joined together by way of a yoke section 7 and are in each instance composed of two arm sections 6′ and 6″ bent off at right angles to one another. The arms 6 of the bracketlike reinforcing rods 3 are passed through corresponding openings of the base 4 so that the arm section 6′ of the bracket 3 becoming the yoke section 7 extend away, approximately perpendicularly, beyond the outside of the base 4 from the inner space 8 of the securing element 2, while the arm sections 6″ are provided running approximately parallel to the plane of the base 4 in the inner space 8 of the securing element 2, which is closed off on the open side facing the base 4 by a cover and at either end of the securing element 2 by corresponding close-off pieces. The reinforcing connection 1 is used in the manner known per se, i.e., the securing element 2, preassembled with the reinforcing rods 3, is arranged in a form for producing a first concrete structural part, for example, the concrete wall 9, where an additional concrete structural part, for example, the concrete wall 10, is to be attached later, so that the open side of the securing element 2, closed off by a cover, is located directly at the inner surface of the form for the concrete wall 9. After the concrete wall 9 has been finished, the securing element 2 and the reinforcing rods 3 are embedded in the concrete of this concrete wall by their arm sections 6′ and their yoke section 7, and after removal of the form from the concrete wall 9 the turned-down arm section 6″ can be bent up, as indicated by the arrow A in FIG. 2, so that when the concrete wall 10 is produced the bent-up arm sections 6″ are embedded in the concrete of this concrete wall. The securing element 2, consisting essentially of steel plate, remains as a lost form in the concrete between the concrete walls 9 and 10.

Although the securing element 2 is likewise completely covered by the concrete of the concrete walls 9 and 10, it is not impossible that porosities may develop at the transition region between concrete and securing element 2, through which moisture may reach not only the securing element but the reinforcing rods 3 forming the connecting reinforcement between the concrete walls 9 and 10 as well, and thus corrosion may occur there. To prevent this and to obtain a transition between securing element 2 and concrete without porosities, the securing element 2 and/or its base 4 and legs 5 are made of a steel plate 11 which, on both the inside of the securing element 2 and on the surface side forming the outside of this securing element, is in each instance provided with a layer 12 of aluminum or of an aluminum alloy. In the embodiment illustrated, each layer 12 has a thickness d, only relatively small compared to the thickness D of the steel plate 11, i.e., d amounts, for example, to 20 micrometers, while the thickness D of the steel plate is greater than 0.3 mm, i.e., lies in the order of magnitude of between 0.3 mm and 1.0 mm.

If an aluminum alloy is used for the layers 12, this contains, for example, more than 50%, e.g., 55–75% aluminum, the remainder being formed at least partially of zinc.

When the concrete of the concrete walls 9 and 10 sets, the material of the layers 12 reacts with the cement or with the free lime and oxygen to form calcium aluminate, owing to which a particularly intimate bond is obtained between the securing element 2 and the adjoining concrete. In this connection, the thickness d of the layers 12 is selected so that, on the one hand, the calcium aluminate formation required for binding in, i.e., retaining, the securing element 2 is ensured to the requisite extent but, on the other hand, after the formation of calcium aluminate is completed, i.e., after the concrete sets on the steel plate 11, the necessary binding in is still ensured and, in particular, there is no loss of strength at the region of transition between concrete and securing element 2, nor do electrolytic elements develop which might cause corrosion of the concrete steel forming the reinforcing rods 3.

In one embodiment of the invention, each layer 12 is formed of an aluminum alloy having the following composition:

about 55% aluminum
about 43% zinc
up to approximately 2% silicon.

In this connection, the percentage of silicon preferably amounts to approximately 2% or 1.6%.

The thickness d of each layer 12 in this embodiment lies in the region of between approximately 10 and 40 micrometers, preferably in the region between approximately 20 and 25 micrometers.

FIG. 5 shows a reinforcing connection 1*a*, which in turn has the securing element 2 and the reinforcing rods 3. At the open end facing the base 4 the securing element 2 is closed off by a "cover" which is formed of a blank 109 of a flat material. This rectangular blank 109, whose side turned away from the securing element 2 rests against the inner surface of a form wall 110, projects by in each instance a section 109′ beyond each longitudinal side of the securing element 2 extending perpendicular to the plane of the drawing of FIG. 5. In the embodiment illustrated, the width b of each section 109′ in the plane of the cross section corresponds to a fraction of the width B of the open side of the securing element, i.e., to a fraction of the distance apart of the two legs 5 in the region of this open side of the securing element. In the embodiment illustrated, b is approximately $\frac{1}{3}$ B.

The flat material is in every case profiled to the sections 109′, i.e., provided with burls or projections 111, etc., which, laterally from the securing element 2, provide for an increase of the transfer of shearing force between the concrete structural part made available first (concrete wall 9) and the adjoining concrete structural part (concrete wall 10) with sufficiently deep embedding of the securing element 2 in the concrete. The flat material or the blank 109 is attached in suitable fashion, for example, by gluing, to the free edges of the legs 5, i.e., to the edges formed on the securing element 2 by the bends 5′. The blank 109 consists, for example, of an air-cushion film, wherein the air cushions then form the projections 111, or else of a film of synthetic material, in the deep drawing of which the projections 111 are produced.

Instead of a blank of a flat material with the projections 111, a blank of a flat material which is provided or impregnated with an agent retarding setting of the concrete (concrete retarder) may alternatively be used. Such a flat material would, for example, be exposed aggregate concrete paper or cardboard, which is customarily used in the production of exposed aggregate concrete preforms, for example, exposed aggregate concrete plates.

At the two faces of the securing element 2 the inner space 8 is closed off by corresponding close-off pieces, not illustrated.

The reinforcing connection 1*a* is likewise used in known fashion, i.e., the securing element 2, preassembled with the reinforcing rods and alternatively (in the embodiment) with the blank 109, is provided in a form for making available the first concrete structural part, for example the concrete wall 9, at the inner surface of the form wall 110 where another concrete structural part, for example, the concrete wall 10, is to be attached. Arrangement of the reinforcing connection is effected in such fashion that, as already mentioned above, the blank 109 rests against the inner surface of the form wall 110 and the securing element 2, with its open end against the blank 109, is held resting on the form wall 110. If required, the projecting sections 109' are fixed on the inner surface of the form wall 110.

After completion of the concrete wall 9 the securing element 2 and the reinforcing rods 3 are embedded with their arm sections 6' and their yoke section 7 in the concrete of this concrete wall. After removal of the form from the concrete wall 9, the blank 109 is removed, exposing the inner space 8 of the securing element 2, kept free of concrete. The bent-down arm sections 6'' can then be bent up, so that when the concrete wall 10 is produced the bent-up arm sections 6'' are embedded in the concrete of this concrete wall. The securing element 2, consisting of steel plate, remains as lost form in the concrete between the concrete walls 12 and 13. To obtain a sufficient concrete coverage, i.e., to prevent corrosion of the iron and/or steel parts in the concrete and, at the same time, of the securing element 2 in particular as well, the width B of the securing element 2 at its open side is smaller, by at least twice the width b of a section 109', than the thickness or wall thickness of the concrete wall 10, so that a concrete cover corresponding to at least the width b is obtained for the securing element 2 on both sides. In this concrete cover the projections 111 of the blank 109 form depressions in the concrete of the concrete wall 9 corresponding to these projections, in which the concrete of concrete wall 10 then engages. This "denticulation" ensures a high transfer of shearing force between the two concrete walls 9 and 10 outside the securing element 2 as well. The same is obtained when the blank 109 is made of a flat material with a concrete retarder. The latter permits the set concrete of the concrete wall 9 to form a roughened surface in the region of the protruding sections 109'', which in turn produces intimate denticulation with the concrete of the adjoining concrete wall 9. In the reinforcing connection 1*a*, the securing element 2 provided with the aluminum layers is likewise very firmly embedded in the concrete by the chemical reaction between aluminum and the free lime of the concrete.

The invention has been described above using the example of the reinforcing connection 1. It is understood that numerous additional embodiments of the invention are conceivable, i.e., the invention is in principle applicable to all concrete insert elements made of steel or steel plate.

Unlike the embodiment represented in FIG. 5, it is alternatively possible to design the flat material so that only the sections 109, which extend away beyond the two longitudinal sides of the securing element 2, are provided, while no flat material is provided in the region of the width B. Instead of at least one of the two sections 9', a wood strip 109'' may alternatively be provided, as indicated by broken lines in FIG. 5. Despite the projections 111, the flat material 109 may alternatively likewise be provided with a concrete retarder. The concrete retarder of course may alternatively be used with a flat material without the projections 111 when this flat material forms only the sections 109' and is not provided in the region of the width B.

These and other aspects of the present invention are highlighted in the following numbered paragraphs. The claims appear following these numbered paragraphs.

I claim:

1. Concrete structure having at least one concrete insert element, which in at least a partial region is fabricated of steel and there has at least one surface embedded in concrete or cement of the concrete structure (9, 10), characterized in that the insert element (2) is provided on this surface with a layer (12) of aluminum or of an aluminum alloy, and in that this layer, upon setting of the concrete, has reacted at least partially with the free lime and oxygen to form calcium aluminate, specifically for obtaining a particularly intimate and firm bond between the concrete insert element and the concrete of the concrete structure (9, 10).

2. Concrete structure according to claim 1, characterized in that the layer of aluminum or aluminum alloy has a thickness (d) which is selected so that after embedding of the insert element (2) in the concrete or cement and after setting of the concrete, virtually all the material of the layer (12) of aluminum or of an aluminum alloy has reacted with the free lime of the concrete or cement and with oxygen to form a calcium aluminate, specifically, to at most a small residual thickness.

3. Concrete structure according to claim 1, characterized in that the thickness of the layer (12) of aluminum or of aluminum alloy amounts to under 200 micrometers.

4. Concrete structure according to claim 3, characterized in that the thickness of the layer of aluminum or aluminum alloy lies in the order of magnitude of 20 micrometers.

5. Concrete structure according to claim 3, characterized in that the thickness of the layer (12) of aluminum or of the aluminum alloy lies in the region of between about 10–40 micrometers.

6. Concrete structure according to claim 5, characterized in that the thickness of the layer of aluminum or of the aluminum alloy amounts to approximately 20–25 micrometers.

7. Concrete structure according to claim 1, characterized in that the aluminum alloy forming the layer contains zinc, the percentage of aluminum being greater than 50%, preferably lying between approximately 55–70%.

8. Concrete insert element according to claim 7, characterized in that the aluminum alloy forming the layer contains approximately 55% aluminum and approximately 43% zinc.

9. Concrete insert element according to claim 8, characterized in that the aluminum alloy contains a percentage of approximately 2% silicon.

10. Concrete structure according to claim 8, characterized in that the aluminum alloy contains approximately 1.6% silicon.

* * * * *